US008308013B2

(12) United States Patent
Levy et al.

(10) Patent No.: US 8,308,013 B2
(45) Date of Patent: Nov. 13, 2012

(54) SYSTEM AND METHOD FOR HOLDING A HAZARDOUS SUBSTANCE

(75) Inventors: Leon M. Levy, Chicago, IL (US); Michael W. McCarthy, Sugar Grove, IL (US); Joseph S. Oberweis, Sugar Grove, IL (US); Robert R. Renaut, Naperville, IL (US); Steven D. Koszola, Hanover Park, IL (US)

(73) Assignee: Oberweis Dairy, Inc., North Aurora, IL (US)

( * ) Notice: Subject to any disclaimer, the term of this patent is extended or adjusted under 35 U.S.C. 154(b) by 844 days.

(21) Appl. No.: 12/413,135

(22) Filed: Mar. 27, 2009

(65) Prior Publication Data

US 2010/0243662 A1 Sep. 30, 2010

(51) Int. Cl.
*B65D 45/00* (2006.01)

(52) U.S. Cl. ..... 220/324; 220/4.21

(58) Field of Classification Search ..... 220/324, 220/367.1, 4.21, 326
See application file for complete search history.

(56) References Cited

U.S. PATENT DOCUMENTS

| | | | | |
|---|---|---|---|---|
| 5,377,860 | A | 1/1995 | Littlejohn et al. | |
| 6,074,676 | A * | 6/2000 | Cadiente et al. | 426/106 |
| 6,367,646 | B1 * | 4/2002 | Hoagland et al. | 220/533 |

FOREIGN PATENT DOCUMENTS

| | | |
|---|---|---|
| AU | 587 314 | 8/1989 |
| CA | 2 582 313 | 9/2008 |
| EP | 1 205 401 | 5/2002 |
| WO | 03/102480 | 12/2003 |

OTHER PUBLICATIONS

Invitation to Pay Additional Fees and Partial International Search Report in related International Patent Application No. PCT/US2010/026663, dated Jun. 15, 2010.

* cited by examiner

*Primary Examiner* — Steven A. Reynolds
*Assistant Examiner* — King M Chu
(74) *Attorney, Agent, or Firm* — Banner & Witcoff, Ltd.

(57) ABSTRACT

Systems and containers for holding and transporting potentially hazardous materials are disclosed. Assembled containers may have locking mechanisms reducing the possibility of the containers being opened by persons that are not opening the container in a safe environment. Moreover, containers with releasably securable members for carrying substances such as frozen carbon dioxide, used for maintaining cold temperatures of various items are disclosed.

15 Claims, 7 Drawing Sheets

SYSTEM AND METHOD FOR HOLDING A HAZARDOUS SUBSTANCE

FIELD OF THE INVENTION

The invention relates to systems and methods for storing hazardous substances to minimize exposure and access to the hazardous substance.

BACKGROUND

Potentially hazardous substances, such as frozen carbon dioxide (commonly referred to as dry ice), may need to be transported and require special handling. Containers for hazardous substances are generally known in the art. In particular, containers for hazardous substances are frequently designed to prevent the need for a person to come in direct contact with the substance.

While such containers, according to the prior art, provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to a container for holding a hazardous substance, comprising two container members. A first container member defines a cavity and has a top including a vent and a clip, a first side including a first locking member, and a second side including a second locking member. A second container member defines a cavity and has a bottom including a vent and a clip, a first side including a third locking member, and a second side including a fourth locking member. Furthermore, the first locking member and the third locking member are configured to engage each other and the second locking member and the fourth locking member are configured to engage each other, thereby securing the first container member to the second container member.

Further aspects of the invention relate to the container members having a plurality of locking members on some or all of the sides of the two container members. Additional aspects relate to some or all of the sides of the two container members having ridges, which may provide grip. Other aspects of the invention relate to providing warnings on the container and providing a plurality of vents and/or clips on the surfaces of the container members. Aspects of the invention relate to the clips being configured to be received by complementary structure on a cooler or other device where the container member may be used. Certain aspects of the invention relate to the clips, or other protrusions, that may extend over the vent(s) configured to prevent a person from placing a finger inside the assembled container or removing the contents from the assembled container.

Additional aspects of the invention relate to a cooler configured to hold the container. Moreover, other aspects of the invention relate to a device for opening the container once the container is assembled and locked.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures in accordance with the invention, reference is made to the accompanying drawings, which form a part hereof, and in which are shown, by way of illustration, various example systems in accordance with aspects of the invention. Additionally, it is to be understood that other specific arrangements of parts and structures may be utilized and structural and functional modifications may be made without departing from the scope of the present invention. Also, while the terms "top," "bottom," "side," "end," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

In general, as described above, aspects of this invention relate to systems and methods for containing and transporting potentially hazardous materials in a safe and efficient manner. Specific examples of the invention are described in more detail below. The reader should understand that these specific examples are set forth merely to illustrate examples of the invention, and they should not be construed as limiting the invention.

Figure 1:
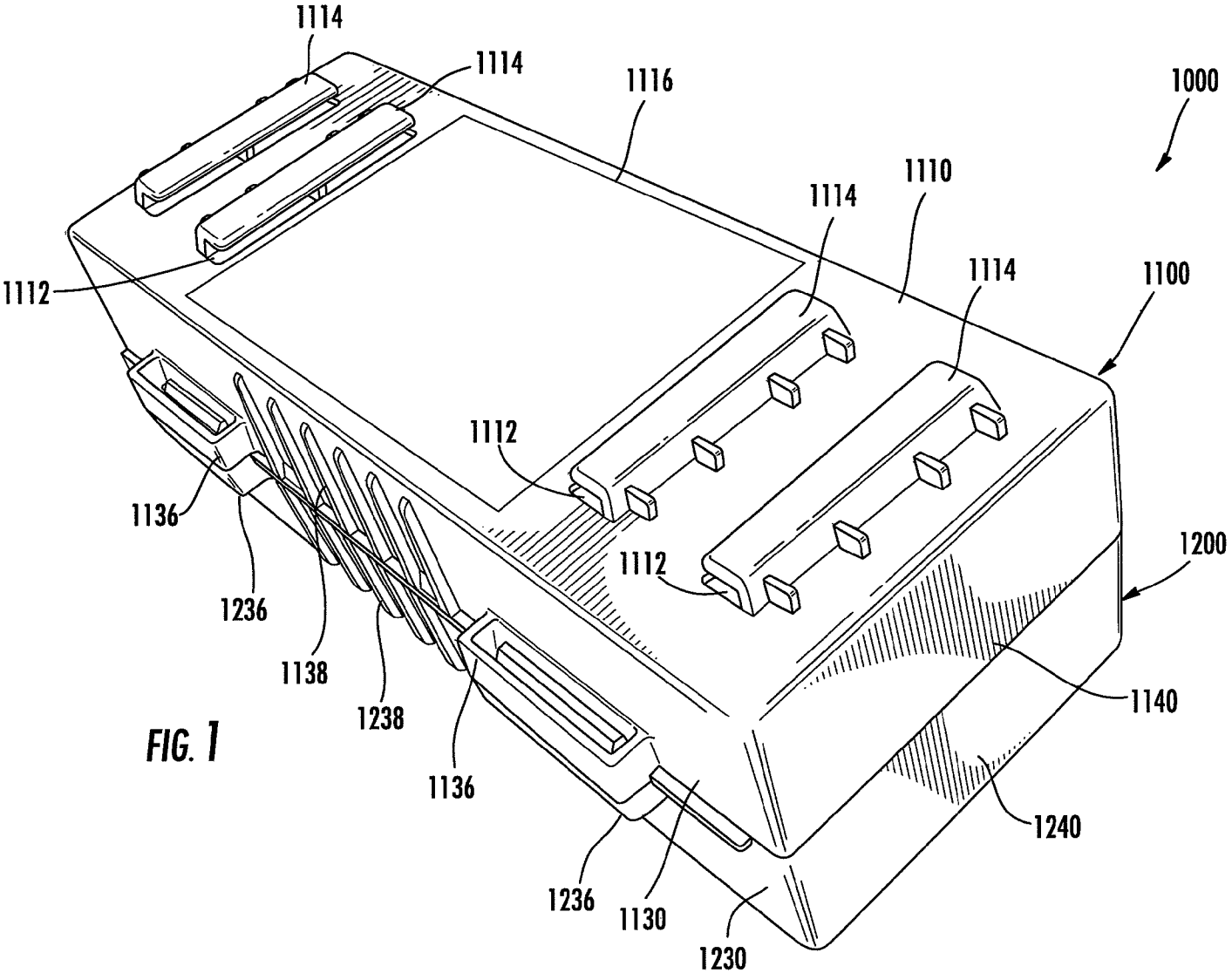
FIG. 1 generally illustrates a perspective view of an illustrative container according to embodiments of the invention.

Referring to the drawings, FIGS. 1 and 4-6 depict an assembled container for holding a potentially hazardous material (in one example, frozen carbon dioxide, commonly known as dry ice), generally designated by the reference numeral 1000. As shown in the figures, container 1000 generally has a first container member 1100 and a second container member 1200. FIG. 1 depicts first container member 1100 and second container member 1200 connected together to form assembled container 1000. First container member 1100 and second container member 1200 may be of any shape or size, as long as the portions of the two container members

1100 and 1200 that meet are shaped such that container 1000 may contain a substance such as frozen carbon dioxide.

The two container members 1100 and 1200 may be made of a plastic material appropriate for storing the potentially hazardous material. In one embodiment, container members 1100 and 1200 may be composed of polyurethane. The use of polyurethane would be appropriate for an application such as the embodiment depicted here for holding and transporting frozen carbon dioxide. The ability to reach very cold temperatures without destroying the structural integrity of container 1000 is one benefit provided by polyurethane. Of course, other materials may be used depending on the desired function and properties of container 1000.

Figure 2:
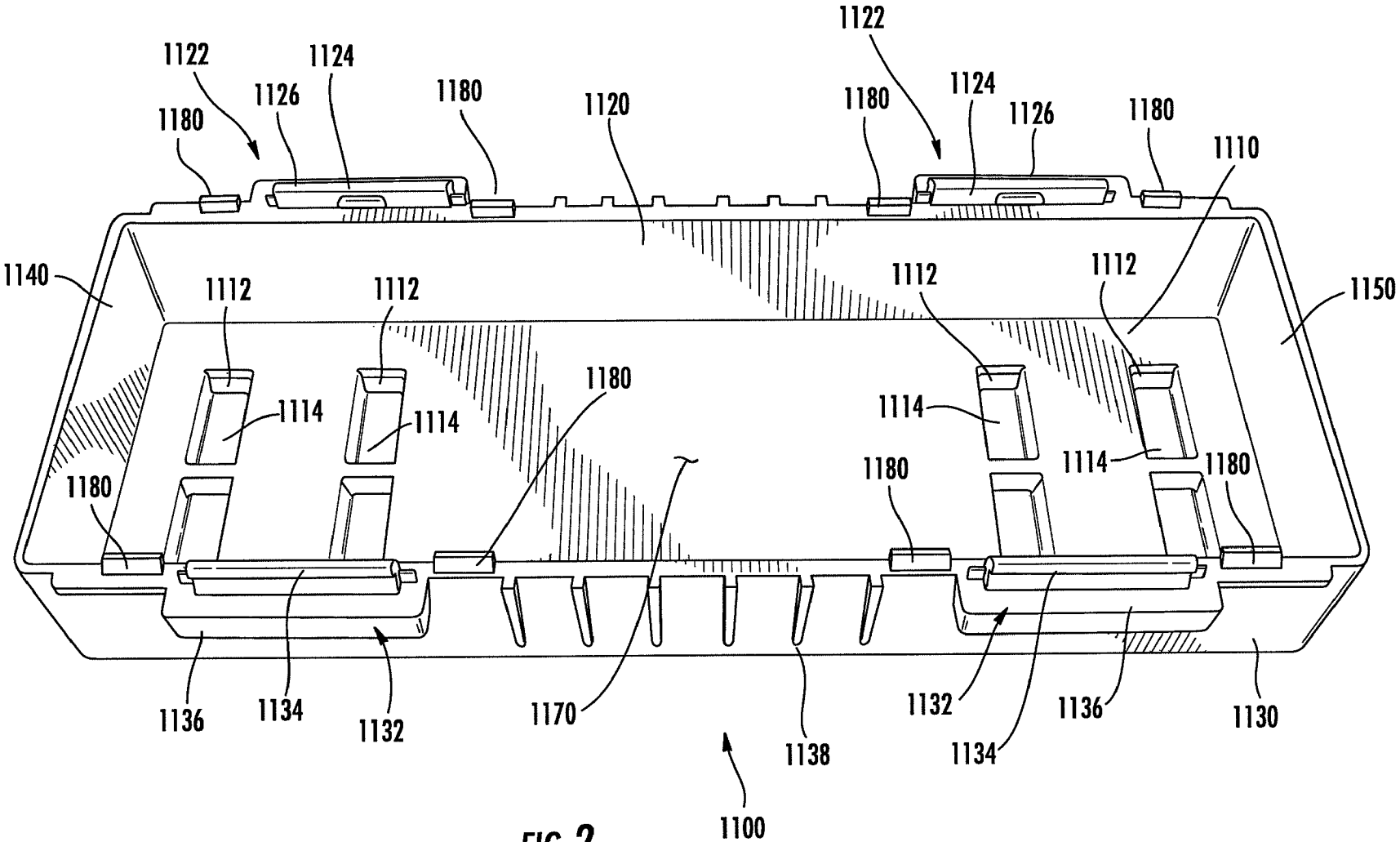
FIG. 2 provides a view of a top portion of an illustrative container according to embodiments of the invention.

In one embodiment, as depicted in FIGS. 1-2, first container member 1100 may be a substantially rectangular member, with a top 1110, a first side 1120, a second side 1130, a first end, 1140, and a second end 1150. Furthermore, first container member 1100 may have an open bottom 1116, such that first container member 1000 defines a cavity 1170 extending between ends 1140 and 1150 and sides 1120 and 1130. Additionally, as will be described below, second container member 1200 may have a similar structure such that when assembled with first container member 1100, assembled container 1000 forms a substantially rectangular hollow container 1000.

Figure 4:
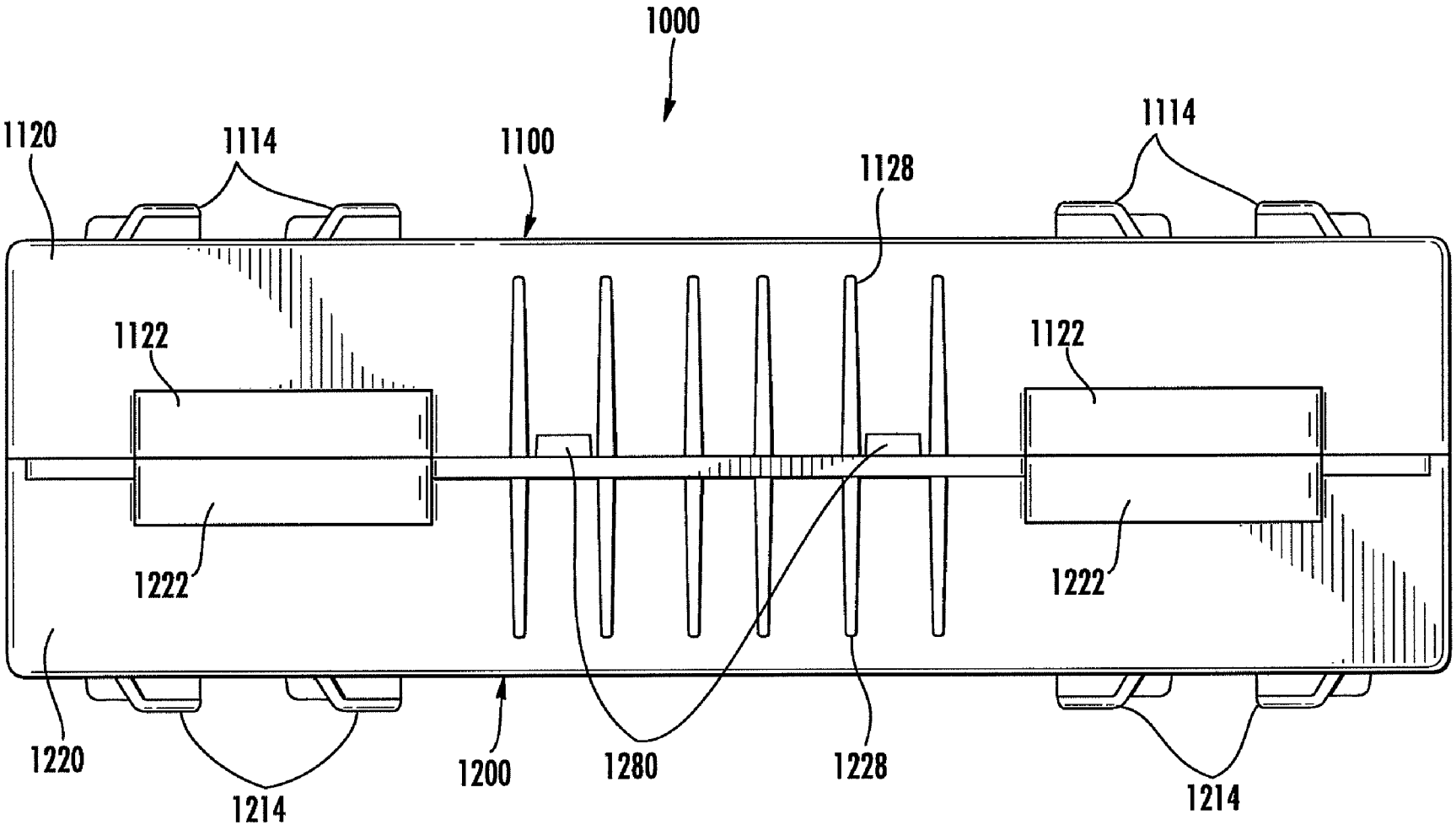
FIG. 4 provides a side view of an illustrative container according to embodiments of the invention.

In the embodiment depicted in FIGS. 1-2, top 1110 of first container member 1100 may include any combination of various features described herein. In some embodiments, top 1110 may include one or more openings or vents 1112. Top 1110 may also include a substantially planar surface 1118 that may allow for the display of warnings or other information relevant to the contents or proper handling of container 1000. In some embodiments, the information or warnings on planar surface 1118 may be applied through a heat stamp. In other embodiments, substantially planar surface 1118 may have certain information or warnings molded into second container member 1100, or the information or warnings may be added at a later time by using any of various methods, including stickers, writing directly on the container, etc. In certain embodiments, top 1110 may also include one ore more clips 1114. In the embodiment depicted in the figures, top 1110 may include four vents 1112, with four clips 1114 substantially adjacent to vents 1112. FIGS. 1-2, and 4 also show vents 1112 to be of similar size and shape. In other embodiments, there may be more than four or fewer than four vents 1112. Additionally, any number of vents 1112 may be of a different shape or size from any of the other vents 1112. Certain embodiments of first container member 1100 may optionally include a handle 1118, attached to top 1110.

One or both of sides 1120 and 1130 of first container member 1100 may include ridges 1128 and 1138 or other elements that may be useful in gripping first container member 1100, either for carrying first container member 1100 or for engaging or disengaging first container member 1100 with second container member 1200. First container member may also include protrusions 1180 extending from any of first side 1120, second side 1130, first end 1140, and second end 1150 beyond the plane of open bottom 1116.

Each of sides 1120 and 1130 also may include at least one locking member 1122 and 1132, respectively. In some embodiments, first side 1120 may have multiple locking members 1122 and second side 1130 may have multiple locking members 1132. In the embodiment depicted, first side 1120 has two locking members 1122 and second side 1130 has two locking members 1132. Locking members 1122 and 1132 may be any type of structure that may secure first container member 1100 with second container member 1200. In the embodiment depicted, locking members 1122 and 1132 may include tabs 1124 and 1134 that extend beyond the plane of open bottom 1116. In some embodiments, locking members 1122 and 1132 may include side wall extensions 1126 and 1136 that may extend outward from side walls 1120 and 1130. In some embodiments, side wall extensions 1126 and 1136 may be the portion of locking members 1122 and 1132 that is connected directly to side walls 1120 and 1130 and tabs 1124 and 1134 may extend from side wall extensions 1126 and 1136. Alternatively, side wall extensions 1126 and 1136 may provide additional structural support for tabs 1124 and 1134. In some embodiments, side wall extensions 1126 and 1136 may extend around a substantial portion of tabs 1124 and 1134, respectively.

Variations of these embodiments, such as variations with different elements included on different parts of first container member 1100 are of course contemplated. For example, any of ends 1140 and 1150 and sides 1120 and 1130 may include any number of vents and clips in addition to, or instead of, the vents 1112 and clips 1114 included as part of top 1110 of first container member 1100. In some embodiments, first container member 1100 may not include vents 1112 or clips 1114 at all.

Figure 3:
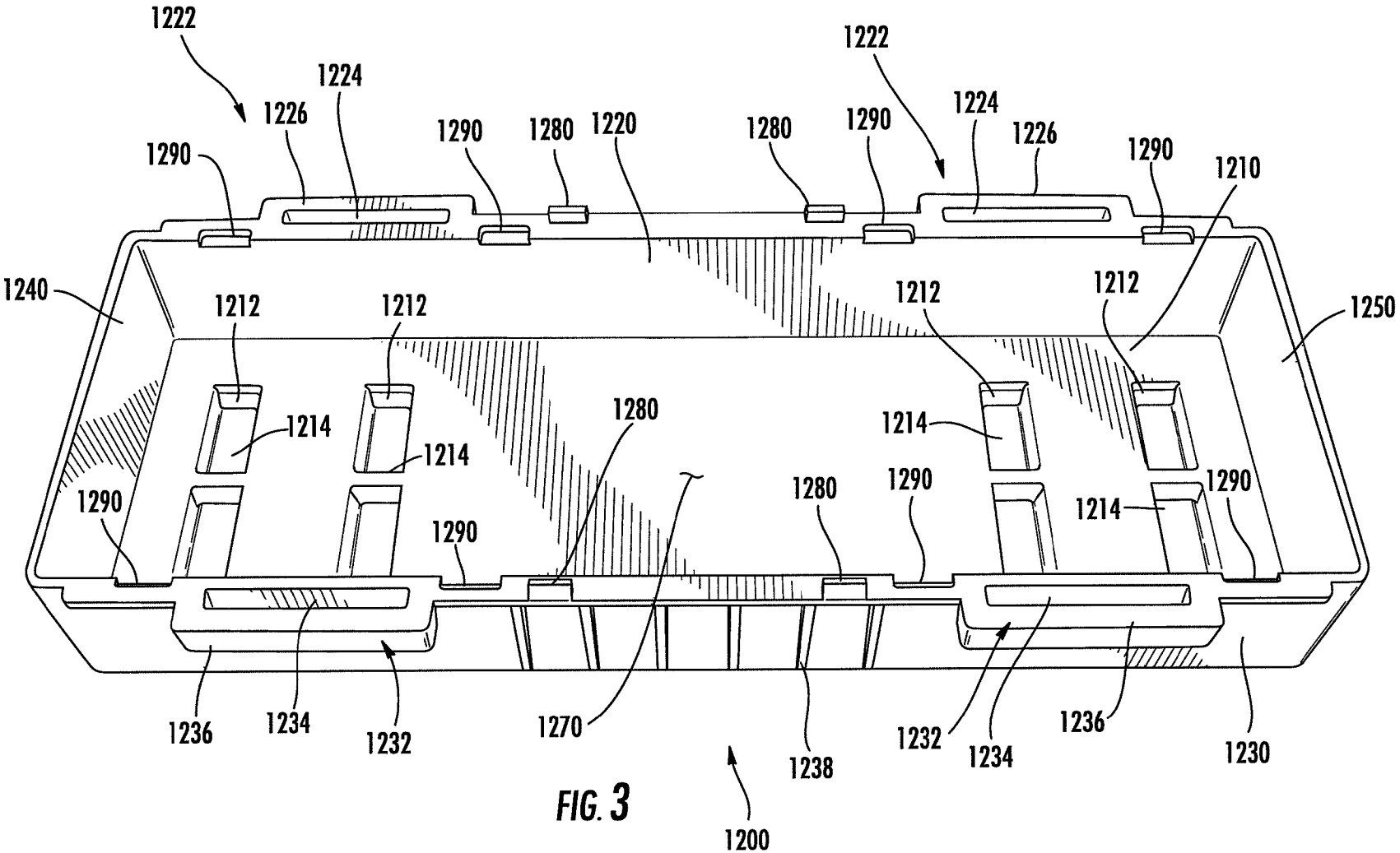
FIG. 3 provides a view of a bottom portion of an illustrative container according to embodiments of the invention.
Figure 5:
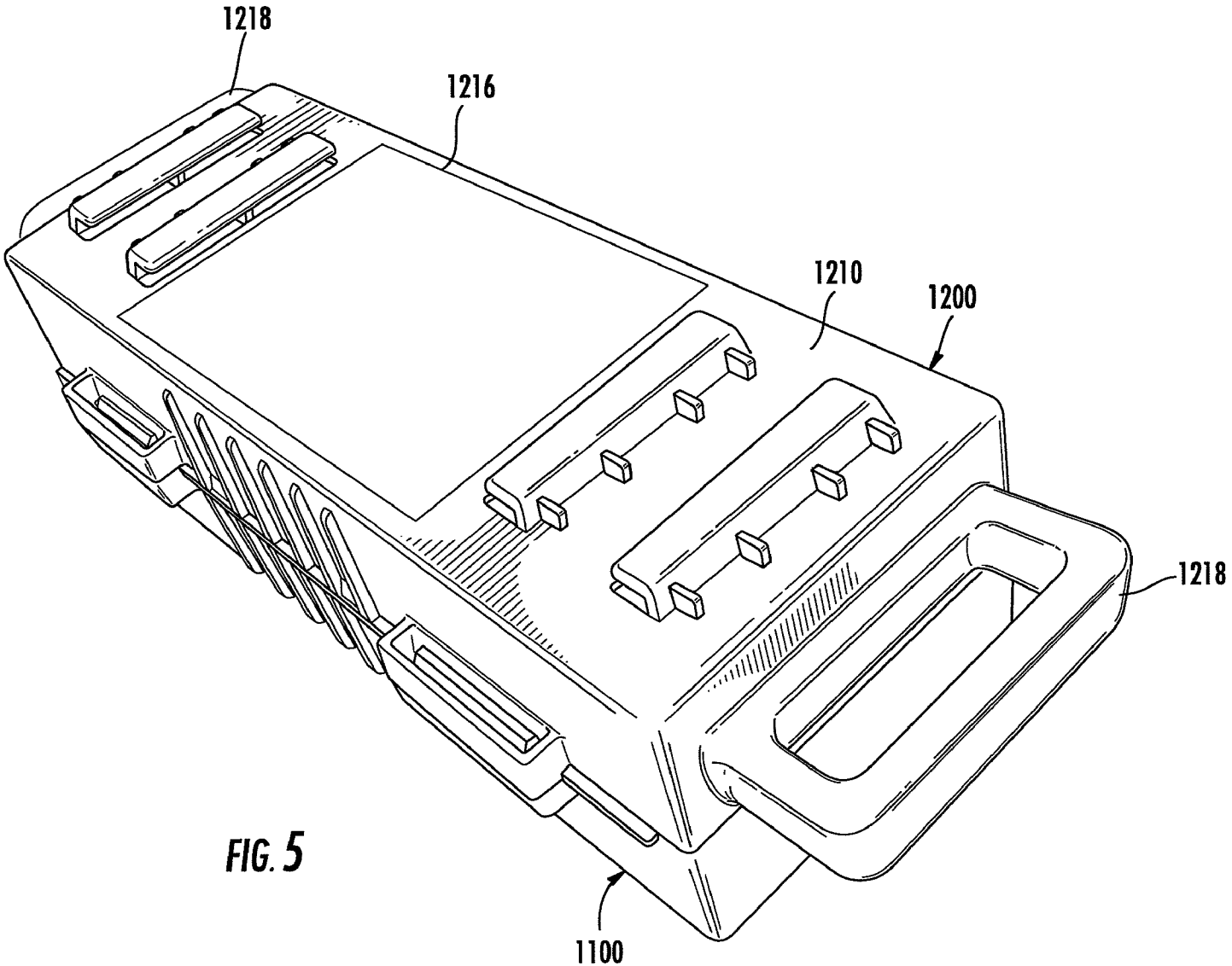
FIG. 5 provides a perspective view of an illustrative container including a handle according to embodiments of the invention.
Figure 6:
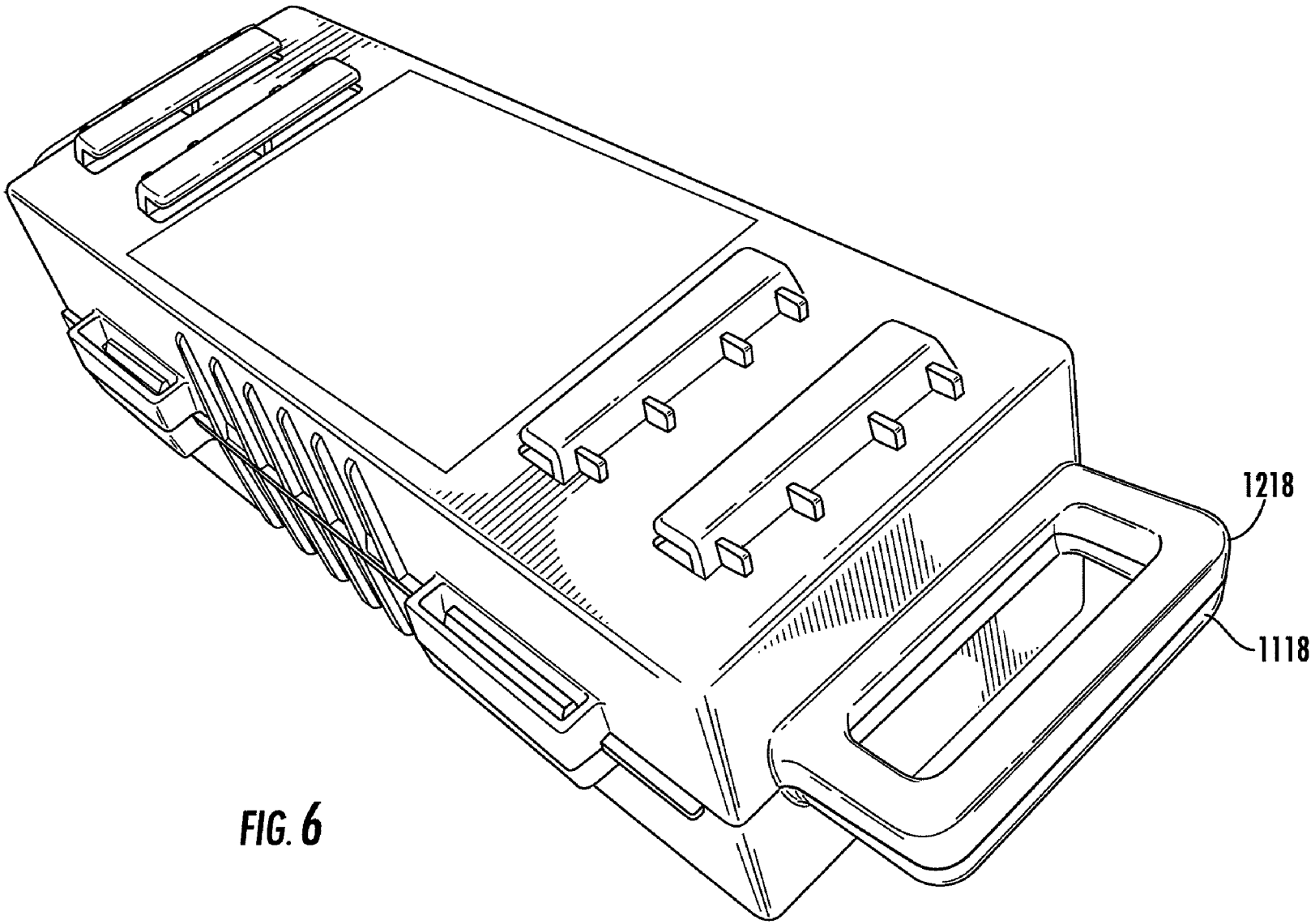
FIG. 6 provides a perspective view of an illustrative container including a handle according to other embodiments of the invention.

Second container member, depicted in FIGS. 3, and 5-6, may be a substantially rectangular member having a bottom, 1210, a first side 1220, a second side 1230, a first end 1240, and a second end 1250. Moreover, second container member 1200 may have an open top 1216, such that second container member 1200 defines a cavity 1270 extending between ends 1240 and 1250 and sides 1220 and 1230. Second container member 1200 may also include protrusions 1280 extending from any of first side 1220, second side 1230, first end 1240, and second end 1250 beyond the plane of open top 1216. In some embodiments, second container member may include recesses 1290 in any of first side 1220, second side 1230, first end 1240, and second end 1250 extending from the plane of open top 1216 towards bottom 1210. As discussed above, open top 1216 of second container member 1200 may be configured to align and mate with open bottom 1116 of first container member 1100, forming a substantially rectangular hollow assembled container 1000.

In the embodiment depicted in FIGS. 3-6, second container member 1200 may include many of the same features included in first container member 1100 and, like first container member 1100, second container member 1200 may include any combination of these features. In certain embodiments, bottom 1210 may include any number of vents 1212. Bottom 1210 may also include a substantially planar surface 1218 that may allow for the display of any information relevant to the contents or proper handling of container 1000. As with first container member 1100, substantially planar surface 1218 may have certain information or warnings molded into second container member 1200, or the information or warnings may be added at a later time by using any of various methods, including stickers, writing directly on the container, etc. In some embodiments, the information or warnings on planar surface 1218 may be applied through a heat stamp. In certain embodiments, bottom 1210 may also include any number of clips 1214. In the embodiment depicted in the figures, bottom 1210 includes four vents 1212, with four clips 1214 substantially adjacent to vents 1212. As shown in the figures, vents 1212 are depicted as being of similar size and shape to each other and to vents 1112. Alternative embodiments may include more or fewer than four vents 1212, and each of vents 1212 may be of varying or similar shape and size compared with each other and with vents 1112 without departing from the scope of the invention. In some embodiments, second container member 1200 may include a handle 1218, attached to bottom 1210. In other embodiments, second container member 1200 may include a portion of a handle that, when first container member 1100 and second container member 1200 are assembled, is configured to form a complete handle with a portion of a handle attached to first container member 1100.

As with first container member, side 1220 and/or side 1230 of second container member 1200 may include ridges 1228 and 1238 or other elements that may be useful in gripping second container member 1200. Sides 1220 and 1230 also may include at least one locking member 1222 and 1232, respectively. In some embodiments, side 1220 may have multiple locking members 1222 and side 1230 may have multiple locking members 1232. In the embodiment depicted, side 1220 has two locking members 1222 and side 1230 has two locking members 1232. Locking members 1122 and 1132 may be any type of structure that may secure first container member 1100 with second container member 1200. In the embodiment depicted, locking members 1222 and 1232 may include slots 1224 and 1234 formed by side wall extensions 1226 and 1236.

As mentioned above, any combination of these features may be present in various embodiments, and embodiments with elements included on different parts of second container member 1200 are contemplated. For example, any of ends 1240 and 1250 and sides 1220 and 1230 may include any number of vents and clips in addition to, or instead of, the vents 1212 and clips 1214 included as part of bottom 1210 of second container member 1200. In some embodiments, second container member 1200 may not include vents 1212 or clips 1214 at all.

In various embodiments, the shape and size of first container member 1100 and second container member 1200 may vary according to the function and properties desired for assembled container 1000. For example, in some embodiments, each container member 1100 and 1200 may have a substantially hemispherical shape, a substantially pyramidal shape, or any other shape. Additionally, the two container members 1100 and 1200 may not have substantially the same shape as long as bottom 1116 of first container member 1100 is configured to align and mate with top 1216 of second container member 1200.

One aspect of the present invention allows a user to place a potentially hazardous substance into one or both of container members 1100 and 1200 and create an assembled container 1000 by utilizing cooperative locking members 1122, 1132, 1222 and 1232 of the first container member 1100 and the second container member 1200. For example, FIGS. 1, and 4-6 show an assembled container that may be used for holding frozen carbon dioxide. As can be seen from the figures, locking members 1122 may be connected to locking members 1222. Similarly, locking members 1132 may be connected to locking members 1232. In the embodiment shown in FIGS. 2-3, the tabs 1124 and 1134 of locking members 1122 and 1132 may be inserted into the slots 1224 and 1234 of locking member 1222 and 1232. In some embodiments, portions of side wall extensions 1126 and 1226 may substantially surround tabs 1124 and may provide protection from tabs 1124 breaking and may also provide additional security so that the connected locking mechanism 1124 and 1134 is not easily disconnected. Similarly, portions of side wall extensions 1136 and 1236 may substantially surround tabs 1134.

In some embodiments, when locking members 1122 and 1222 and locking members 1132 and 1232 are engaged, the assembled container 1000 may be secured, such that disengaging first container member 1100 from second container member 1200 may require a special tool or device. Such a configuration may provide protection to a person who is transporting the hazardous substance. Additionally, such a configuration may prevent children or others from touching or removing the contents held by assembled container 1000. Ultimately, in embodiments where assembled container 1000 holds frozen carbon dioxide, assembled container 1000 may assist in the safe delivery of a frozen product.

Another aspect of the invention may require a special tool to unlock assembled container 1000 once locking members 1122 and 1132 are engaged with 1222 and 1232, respectively. In one embodiment, an aspect of the invention utilizes a modified arbor press for disengaging locking members 1122 and 1132 from locking members 1222 and 1232, respectively. In such an embodiment, the modified arbor press may function to disengage tabs 1124 and 1134 from slots 1224 and 1234. Such a tool may operate similar to a drill press in that assembled container 1000 may be placed on a surface allowing for the arbor press to come down and disengage locking members 1122 and 1222. Subsequently, assembled container may be realigned so that when the arbor press is lowered to assembled container, the arbor press may disengage locking members 1132 and 1232.

Recesses 1290 and protrusions 1180 and 1280 may provide a snug fit between first container member 1100 and second container member 1200. The embodiment depicted in FIG. 3 shows protrusions 1280 on both of sides 1220 and 1230. In such an embodiment, protrusions 1280 overlap both sides 1120 and 1130 between ridges 1128 and 1138, respectively. The embodiment depicted in FIGS. 2-3 also shows protrusions 1180 on both of sides 1120 and 1130 and matching recesses 1290 on sides 1220 and 1230. Recesses 1290 may be configured to receive protrusions 1180, once again providing a more snug fit between first container member 1100 and second container member 1200. In other embodiments, recesses 1290 and protrusions 1180 and 1280 may alternatively, or in addition, be on at least one of ends 1140, 1150, 1240, and 1250. Additionally, in some embodiments, first container member 1100 may have recesses instead of or in addition to second container member 1200 as long as the protrusion members of the opposite container member are configured to engage the recesses.

Vents 1112 and 1212 may allow gaseous carbon dioxide to dissipate when frozen carbon dioxide begins to evaporate. The number, sizes and shapes of vents 1112 and 1212 may be adjusted based on the amount of ventilation that is needed for the particular application, the amount of frozen carbon dioxide present, the desired time of evaporation, etc. Clips 1114 and 1214 may prevent a person from intentionally or accidentally placing a finger or other object through vents 1112 and 1212, preventing accidental burns or removal of portions of the frozen carbon dioxide. Moreover, in some embodiments, clips 1114 and 1214 may provide a method for attaching assembled container 1000 to a cooler or other apparatus that may have need for such a container.

Top 1110 of first container member 1100 may have a large flat surface 1118 and, similarly, bottom 1210 of second container member 1200 may have a large flat surface 1218. The flat surfaces 1118 and 1218 may provide space for putting information on assembled container 1000. Flat surfaces 1118 and 1218 may have information (such as messages or warnings) on them via molding a message into first container member 1100 and/or second container member 1200, via stickers placed on flat surface 1118 and/or 1218, or via any other means known for displaying warnings or other information.

Another feature that may be present in some embodiments is a handle. As described above, there are many ways that a handle may be included as part of assembled container 1000. In some embodiments, first container member 1100 may have a handle 1118 attached to top 1110. In other embodiments, second container member 1200 may have a handle 1218, instead of or in addition to handle 1118, attached to bottom 1210. In other embodiments, assembled container 1000 may have a handle or handles attached to any of the sides or ends of either or both of first container member 1100 and second container member 1200. An embodiment with handles attached to ends 1240 and 1250 is depicted in the embodiment shown in FIG. 5. For example, in some embodiments, like the embodiment depicted in FIG. 6, each of first container member 1100 and second container member 1200 may include portions of one or more handles, such that the portions of the handle or handles are configured to form a complete handle or handles when first container member 1100 is engaged with second container member 1200.

Figure 7:
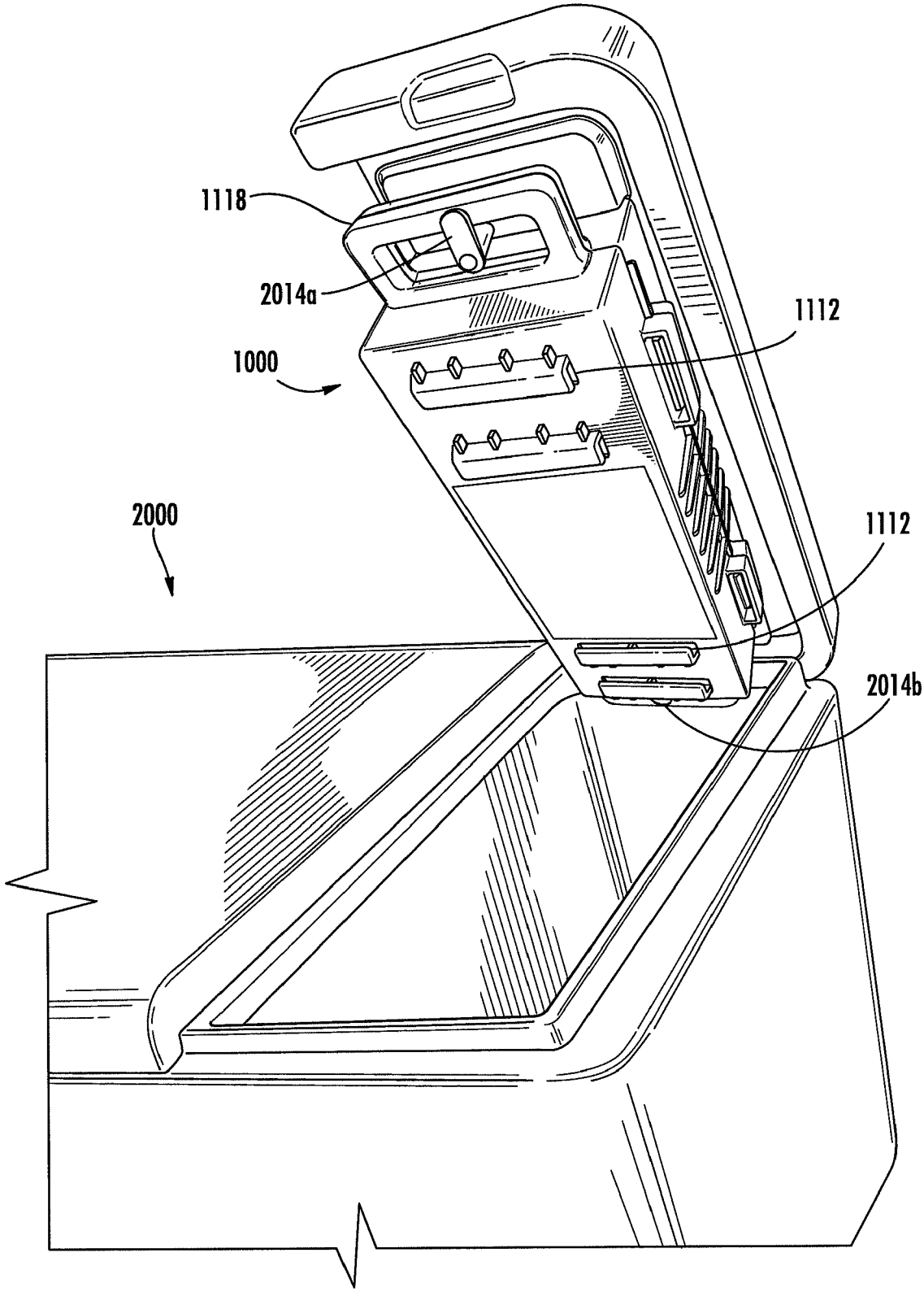
FIG. 7 provides a perspective view of an illustrative container and cooler according to embodiments of the invention.

The handle or handles of assembled container 1000 may be useful for carrying container 1000 or for attaching container 1000 to a cooler 2000, as depicted in FIG. 7. Cooler 2000 may be a cooler of any of various shapes or designs. In some embodiments, cooler 2000 may simply be a box (like a milk box) with insulating properties. In such embodiments, container 1000 may be placed inside the box along with the contents that require cooling. In other embodiments, cooler 2000 may be designed such that it is configured to receive any of various embodiments of container 1000. As depicted in FIG. 7, cooler 2000 may contain at least two compartments, one for items that should be refrigerated (e.g. milk) and one for items that should be frozen (e.g. ice cream). Cooler 2000 may include tabs 2014, configured to engage container 1000. In the embodiment depicted in FIG. 7, tabs 2014 may rotate from an open or receiving position (depicted by the position that tab 2014*a* is in) or a closed or locking position (depicted by the position that tab 2014*b* is in). In other embodiments, tabs 2014 may configured to engage clips 1114 and 2114.

Assembled container may be made out of various plastics or other materials and may be manufactured by various means known in the art. In some embodiments, assembled container is molded out of polyurethane, which may maintain structural integrity when coming into repeated contact with extremely cold temperatures. Additionally, as previously mentioned, container 1000 may be of many different sizes and shapes. In one embodiment, assembled container may be sized to hold a standard size cut of frozen carbon dioxide. In embodiments where container 1000 may be used to transport and store ice cream for up to 8 hours, a standard cut of frozen carbon dioxide of approximately 10 inches by 3 inches by 3 inches may be used. In other embodiments, frozen carbon dioxide, or other substances to be held by container 1000 may be cut or formed to fit within container 1000. Obviously, when storing frozen carbon dioxide, container could be used in many different applications where items need to remain at a low temperature. For example, container 1000 may be useful for transportation or temporary storage in the medical field or for frozen meats or other foods.

Moreover, in addition to the possibility of having various sizes and shapes for container 1000, first container member 1100 and second container member 1200 may be of varying size and shape. Although first container member 1100 and second container member 1200 are depicted as being of approximately the same size and shape in FIGS. 1-6, that may not be so in other embodiments. For example, in some embodiments, first container member 1100 could have much shorter sides and ends than second container member 1200. In other embodiment, first container member 1100 may be of a generally half-oval shape. Second container member 1200 may be of a similar half-oval shape or of a generally rectangular shape with edges that are configured to mate with the edges of first container member 1100.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A container for holding a hazardous substance, comprising:

a first container member defining a cavity and having:
- a top including:
  - a vent; and
  - a clip extending over the vent and further configured to attach the container to an apparatus;
- a first side including a first locking member; and
- a second side including a second locking member;

a second container member defining a cavity and having:
- a bottom including:
  - a vent; and
  - a clip extending over the vent and further configured to attach the container to an apparatus;
- a first side including a third locking member;
- a second side including a fourth locking member, wherein the first locking member and the third locking member are configured to engage each other, and wherein the second locking member and the fourth locking member are configured to engage each other, securing the first container member to the second container member; and a cooler including:
- a first compartment; and
- a second compartment having at least one tab configured to engage the clip of the top of the first container member and the clip of the bottom of the second container member.

2. The container of claim 1, wherein the first locking member comprises a tab extending in a direction generally away from the top and the third locking member comprises a slot configured to receive the first locking member and wherein the second locking member comprises a tab extending in a direction generally away from the top and the fourth locking member comprises a slot configured to receive the second locking member.

3. The container of claim 1, wherein the first side of the first container member includes a first plurality of locking members, the second side of the first container member includes a second plurality of locking members, the first side of the second container member includes a third plurality of locking members, and the second side of the second container member includes a fourth plurality of locking members.

4. The container of claim 3, wherein each locking member of the first plurality of locking members and the second plurality of locking members comprises a tab extending in a direction generally away from the top and each locking member of the third plurality of locking members and the fourth plurality of locking members comprises a slot configured to receive the tab of a corresponding locking member of the first plurality of locking members and the second plurality of locking members.

5. The container of claim 1, wherein at least one of the first side of the first container member, the second side of the first container member, the first side of the second container member, and the second side of the second container member further includes a plurality of ridges.

6. The container of claim 1, wherein the first container member and the second container member are of a generally rectangular shape.

7. The container of claim 1, wherein the top of the first container member includes a plurality of vents.

8. The container of claim 1, wherein the bottom of the second container member includes a plurality of vents.

9. A system for holding a hazardous substance, comprising:

a first container member defining a cavity and having:

a top including:

a generally planar surface configured to display a first warning;

a vent; and a clip extending over the vent;

a first side including:

a first plurality of locking members;

a first plurality of ridges; and a plurality of protrusions, extending in a direction generally away from the top;

a second side including:

a second plurality of locking members;

a second plurality of ridges; and a plurality of protrusions, extending in a direction generally away from the top;

a first end; and a second end; and a second container member defining a cavity and having:

a bottom including:

a generally planar surface configured to display a second warning;

a vent; and a clip extending over the vent;

a first side including:

a third locking member;

a third plurality of ridges;

a plurality of protrusions, extending in a direction generally away from the bottom; and a plurality of recesses, extending in a direction generally toward the bottom;

a second side including:

a fourth locking member;

a fourth plurality of ridges;

a plurality of protrusions, extending in a direction generally away from the bottom; and a plurality of recesses, extending in a direction generally toward the bottom;

a first end; and a second end, wherein the first locking member and the third locking member are configured to mate with each other, and wherein the second locking member and the fourth locking member are configured to mate with each other, securing the first container member to the second container member; wherein upon securement of the first container member to the second container member, at least one of the clips is configured to attach the container to a cooler; and a cooler including:

a first compartment; and a second compartment having at least one tab configured to engage at least one clip of the top of the first container member and the clip of the bottom of the second container member.

10. The system of claim 9, wherein at least one of the top of the first container member and the bottom of the second container member includes a plurality of vents.

11. The system of claim 9, wherein at least one of the top of the first container member and the bottom of the second container member includes a plurality of clips.

12. The system of claim 9, wherein the top of the first container member includes a plurality of vents and a plurality of clips and wherein the bottom of the second container member includes a plurality of vents and a plurality of clips.

13. The container of claim 3, wherein the tab is configured to disengage from the slot only upon proper engagement with a modified arbor press.

14. The container of claim 2, wherein at least one locking member of the first plurality of locking members and the second plurality of locking members comprises a tab extending in a direction generally away from the top and at least one locking member of the third plurality of locking members and the fourth plurality of locking members comprises a slot configured to receive the tab of a corresponding locking member of the first plurality of locking members and the second plurality of locking members; and wherein the tab is configured to disengage from the slot only upon proper engagement with a modified arbor press.

15. The container of claim 3, wherein the container is configured to prevent disengagement of the tabs from the slots by hand.

* * * * *